US009662922B2

(12) United States Patent
Takada

(10) Patent No.: US 9,662,922 B2
(45) Date of Patent: May 30, 2017

(54) DECOLORING APPARATUS FOR DETERMINING WHETHER TO DECOLOR A SHEET

(71) Applicants: Kabushiki Kaisha Toshiba, Tokyo (JP); Toshiba Tec Kabushiki Kaisha, Tokyo (JP)

(72) Inventor: Kazumasa Takada, Numazu Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/749,451

(22) Filed: Jun. 24, 2015

(65) Prior Publication Data

US 2016/0375711 A1 Dec. 29, 2016

(51) Int. Cl.
*B41M 7/00* (2006.01)

(52) U.S. Cl.
CPC ..... *B41M 7/0009* (2013.01)

(58) Field of Classification Search
CPC ..... B41M 7/00; B41M 7/0009; B41M 7/009
See application file for complete search history.

(56) References Cited

U.S. PATENT DOCUMENTS

2013/0293660 A1* 11/2013 Iguchi ..... B41J 29/36 347/179

FOREIGN PATENT DOCUMENTS

JP 2014-010239 1/2014

* cited by examiner

*Primary Examiner* — Kristal Feggins
(74) *Attorney, Agent, or Firm* — Patterson & Sheridan, LLP

(57) ABSTRACT

A decoloring apparatus includes a reading unit that reads an image formed on a sheet and outputs image information corresponding to the read image. A control unit is configured to recognize the image information output by the reading unit and determine whether decoloring using the decoloring unit is performed on the sheet based on the recognized image information.

11 Claims, 8 Drawing Sheets

DECOLORING APPARATUS FOR DETERMINING WHETHER TO DECOLOR A SHEET

FIELD

Embodiments described herein relate generally to a decoloring apparatus, a decoloring method, and a recording medium.

BACKGROUND

Image forming on a sheet using a decolorable coloring agent is performed in order to reuse the sheet by erasing an image formed on the sheet. A decoloring apparatus stores a read image after reading the image which is formed on a sheet. Thereafter, the decoloring apparatus decolors the image formed on the sheet.

In certain cases, a specific sheet may be left out among a plurality of sheets. In such a case, the decoloring apparatus performs reading and decoloring of an image with respect to the plurality of sheets, based on an operation of a user. Thereafter, a specific sheet which is retrieved by referring to image data, is printed using an image forming apparatus. However, when such a process is performed, there is a possibility that excess power consumption may be necessary compared to a usual decoloring process.

DETAILED DESCRIPTION

A decoloring apparatus according to an embodiment includes a reading unit that reads an image formed on a sheet and outputs image information corresponding to the read image. A control unit is configured to recognize the image information output by the reading unit and determine whether decoloring using the decoloring unit is performed on the sheet based on the recognized image information.

Figure 1:
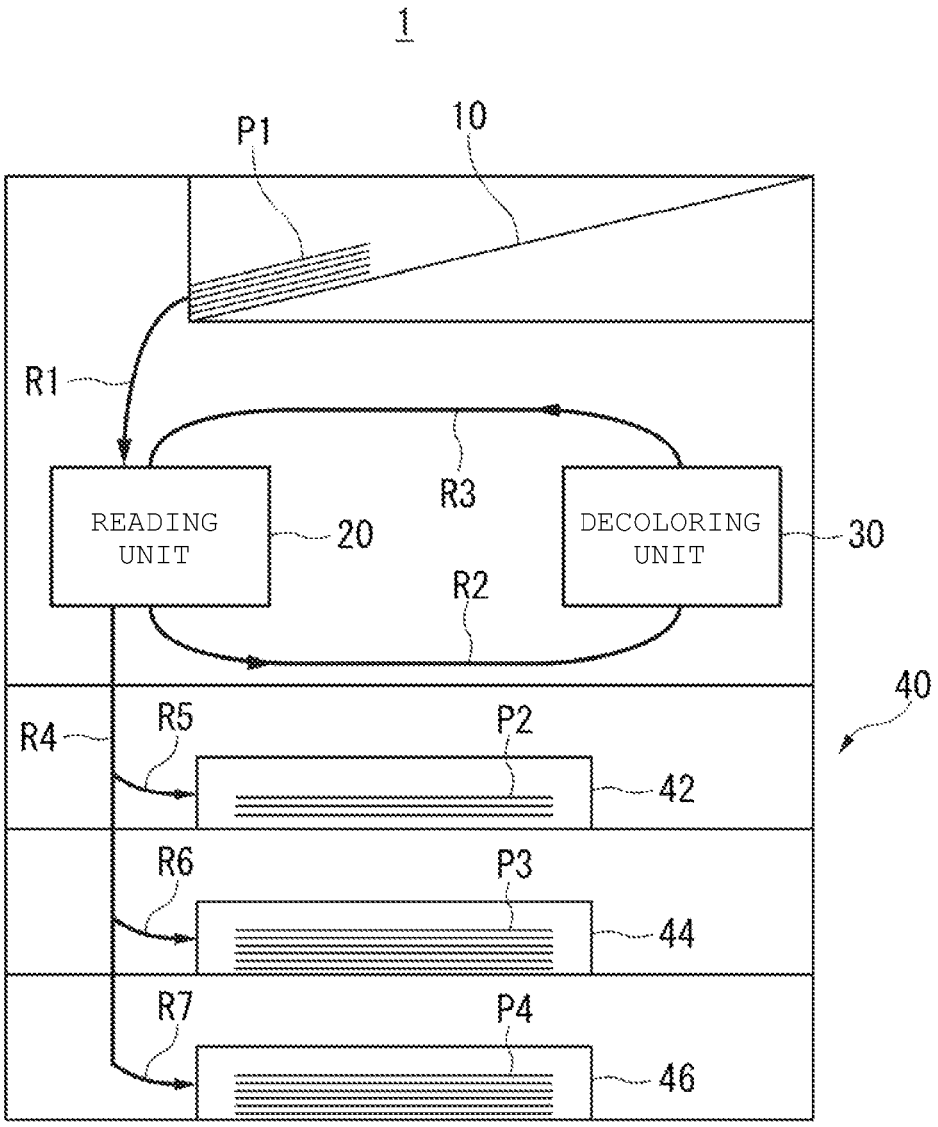
FIG. 1 is a schematic diagram which illustrates a configuration of a decoloring apparatus according to an embodiment.

Hereinafter, a decoloring apparatus 1 according to the embodiment will be described with reference to drawings. In addition, the same portions in each figure will be given the same reference numerals. FIG. 1 is a schematic diagram which illustrates a configuration of the decoloring apparatus 1 according to the embodiment.

The decoloring apparatus 1 decolors an image which was formed using a decolorable coloring agent. The sheet P1 is a sheet-shaped paper sheet (paper, film, or the like) on which an image (character, picture, diagram, or the like) using the decolorable coloring agent is formed.

The coloring agent is toner, ink, or the like, for forming an image on a sheet. Hereinafter, the coloring agent will be described as decolorable toner. The decolorable toner may be decolored, for example, when heat is applied. Specifically, in the decolorable toner, a color is decolored when applied with a higher temperature than a fixing temperature. as another example, the decolorable toner may be ink which is decolored using a chemical process using a solvent, or the like.

The decoloring apparatus 1 includes a sheet feeding unit 10, a reading unit 20, a decoloring unit 30, and a discharging unit 40.

Figure 3:
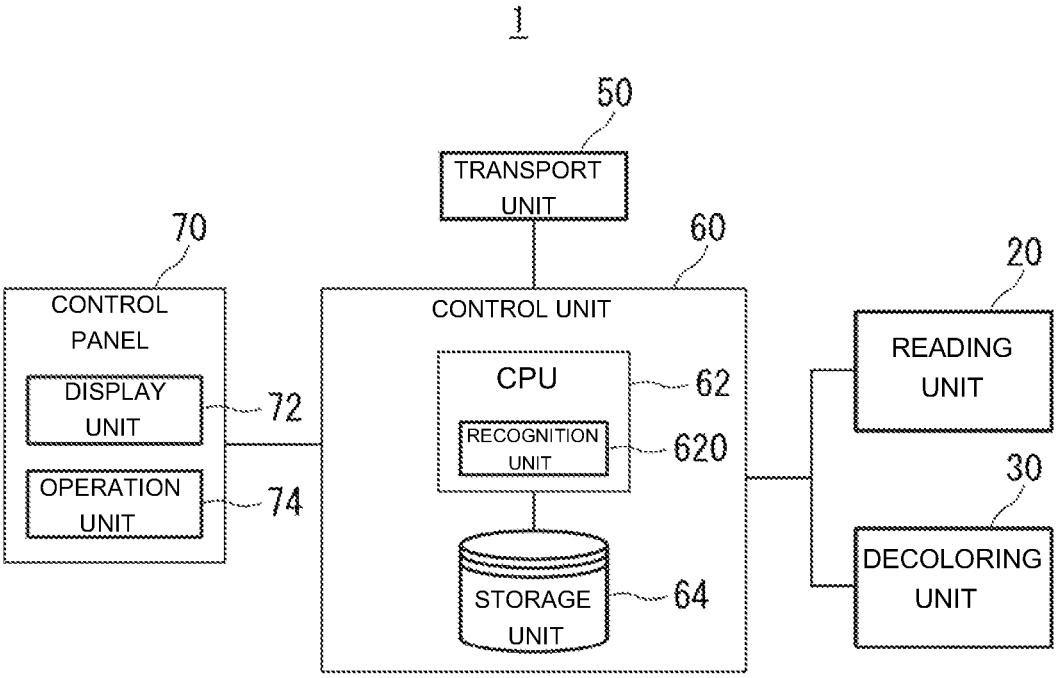
FIG. 3 is a block diagram which illustrates a functional configuration of the decoloring apparatus.

Referring to FIG. 3, the decoloring apparatus 1 includes a transport unit 50 which transports the sheet P1 to the reading unit 20, the decoloring unit 30, and the discharging unit 40. The transport unit 50 transports the sheet P1 through transport paths R1, R2, R3, R4, R5, R6, and R7. The transport unit 50 includes transport rollers and associated motors (not illustrated). Each transport roller is arranged at each portion in the transport paths R1, R2, R3, R4, R5, R6, and R7. Each motor in the transport unit 50 generates a driving torque according to a control of a control unit 60 (refer to FIG. 3). The driving torque rotates the transport roller. Due to a rotating operation of the transport roller, the sheet P1 is transported to each portion of the transport paths R1, R2, R3, R4, R5, R6, and R7.

The sheet feeding unit 10 includes a tray for receiving the sheet P1. The sheet feeding unit 10 includes a sheet feeding roller (not illustrated). The sheet P1 is placed in the sheet feeding unit 10 and is fed by the sheet feeding roller. In this manner, the sheet P1 is transported to the reading unit 20 through the transport path R1.

The reading unit 20 reads an image which is formed on the sheet P1 transported through the transport path R1 or R3. The reading unit 20 may be an image sensor such as an image scanner. The reading unit 20 outputs image information corresponding to the image formed on the sheet P1, and the image information is provided to the control unit 60.

The reading unit 20 may include a front face image sensor, and a rear face image sensor. The reading unit 20 may include only one of the front face image sensor and the rear face image sensor.

The decoloring unit 30 includes a heater for heating the sheet P1. The heater is embedded in a heating roller. The sheet P1 is transported using the heating roller, and is heated using the heating roller. The heater may heat the heating roller using induction heating, for example. As another example, the heater may heat the sheet P1 by supplying power which is subjected to an inverter control to a lamp.

The decoloring unit 30 heats the surface of the transported sheet P1 to a predetermined temperature or higher. The predetermined temperature is a temperature at which the image formed on the sheet P1 is decolored. In this manner, the decoloring unit 30 decolors the image formed on the sheet P1. In addition, the decoloring unit 30 may include two heaters: a front face heater and a rear face heater. The decoloring unit 30 may include only one of the front face heater and the rear face heater.

In the discharging unit 40, the sheet P1 is transported through the transport path R4 from the reading unit 20. The discharging unit 40 accommodates the transported sheet P1 in any one of a plurality of cassettes. The discharging unit 40 includes a retrieving cassette 42, a reuse cassette 44, and a disposal cassette 46. In addition, the discharging unit 40 is described as a cassette for accommodating sheets; however, there is no limitation to the form of the discharging unit 40. For example, the discharging unit 40 may be a tray.

The retrieving cassette 42 accommodates a sheet P2 which matches retrieving conditions which will be described later. The retrieving cassette 42 is an exclusive discharging unit for accommodating the sheet P2. The reuse cassette 44 accommodates a sheet P3 which is reused. The disposal cassette 46 accommodates a sheet P4 which is discarded.

The transport unit 50 includes a switch mechanism which switches a transport destination of the sheet P1 according to a control of the control unit 60. Using the switching mechanism, the transport unit 50 transports the sheet P1 which passes through the reading unit 20 to the transport path R2 or R4. Also, using the switching mechanism, the transport unit 50 transports the sheet P1 which is supplied from the transport path R4 to the transport path R5, R6, or R7.

The control unit 60 controls the switching mechanism to supply the sheet P2 to the retrieving cassette 42, the sheet P3 to the reuse cassette 44, and the sheet P4 to the disposal cassette 46.

Figure 2:
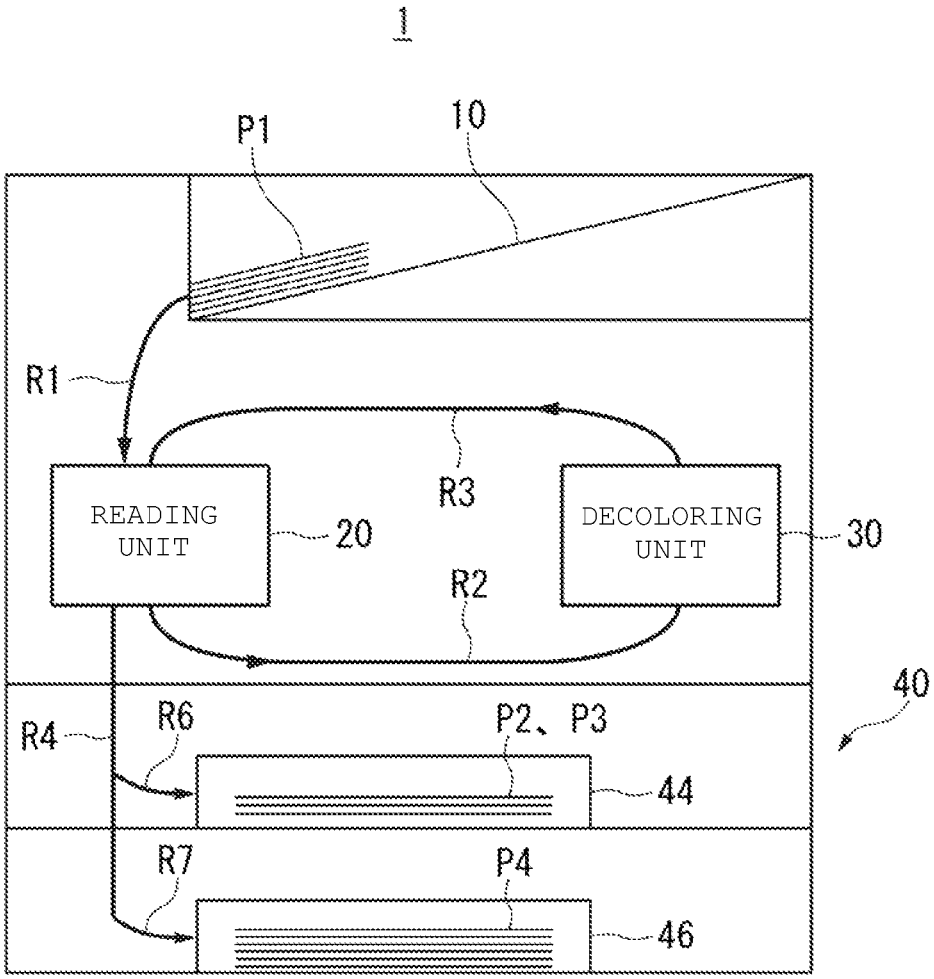
FIG. 2 is a schematic diagram which illustrates another configuration of the decoloring apparatus according to another aspect of the embodiment.

FIG. 2 is a schematic diagram which illustrates another configuration of the decoloring apparatus 1. The decoloring apparatus 1 illustrated in FIG. 2 is different from the decoloring apparatus 1 illustrated in FIG. 1 in not including the retrieving cassette 42. In the decoloring apparatus 1 illustrated in FIG. 2, the transport unit 50 transports the sheet P2 which is determined not to be subjected to decoloring using the decoloring unit 30 to the disposal cassette 46. In the decoloring apparatus 1 illustrated in FIG. 2, the transport unit 50 transports the sheet P2 which matches the retrieving condition, and the sheet P3 which is to be reused, to the reuse cassette 44.

FIG. 3 is a block diagram which illustrates a functional configuration of the decoloring apparatus 1.

The decoloring apparatus 1 includes the control unit 60. The above described reading unit 20, the decoloring unit 30, and the transport unit 50 are connected to the control unit 60. Image data is supplied to the control unit 60 from the reading unit 20. The control unit 60 supplies a control signal for performing decoloring using the decoloring unit 30. The control unit 60 controls the motors and the switching unit of the transport unit 50 so as to transport the sheet P1.

Figure 4:
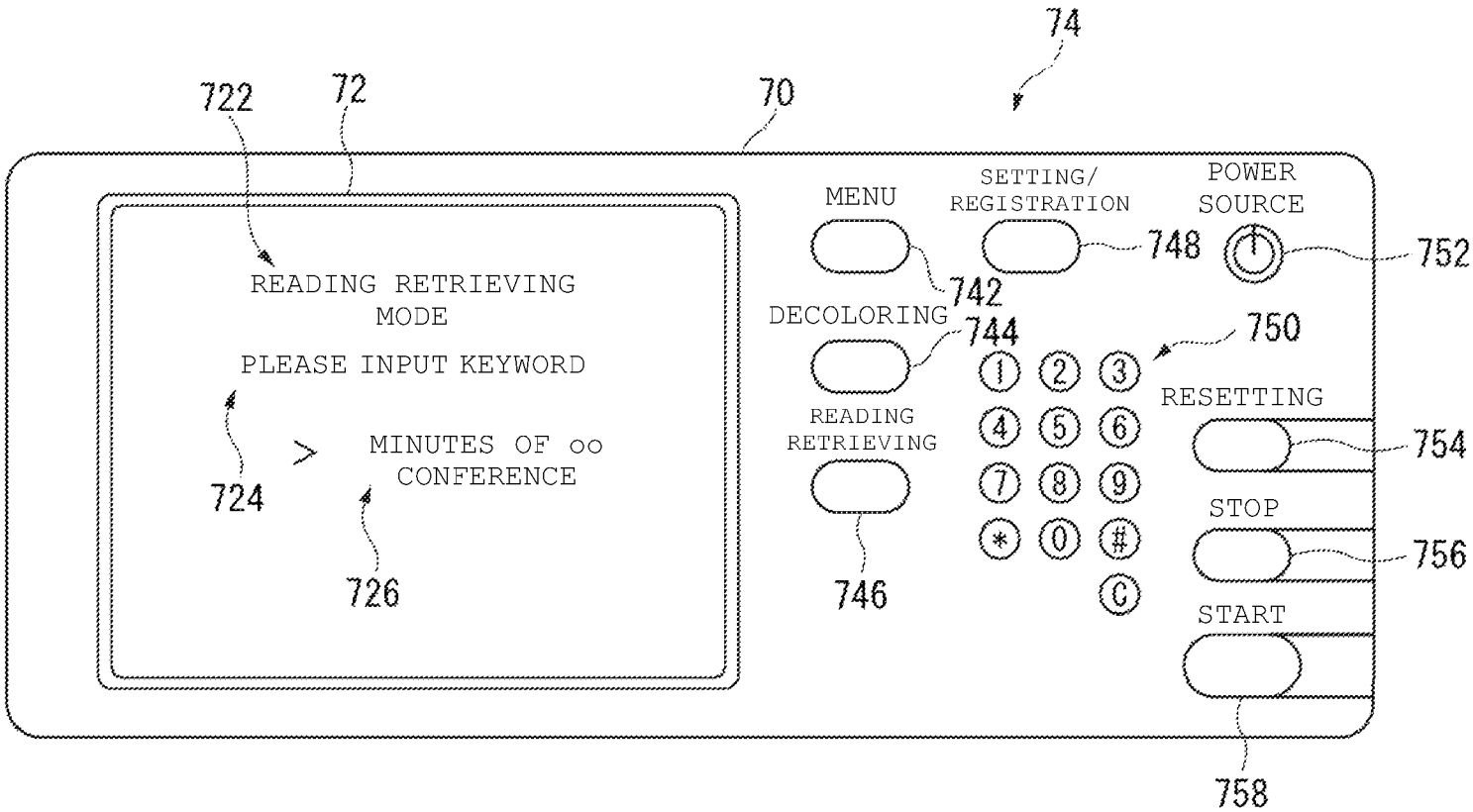
FIG. 4 is a plan view which illustrates a control panel in the decoloring apparatus.

A control panel 70 is connected to the control unit 60. The control panel 70 includes a display unit 72 and an operation unit 74. FIG. 4 is a plan view of the control panel 70.

The display unit 72 displays various information. The display unit 72 includes, for example, a liquid crystal display. The display unit 72 is driven according to display data which is supplied from the control unit 60. The display unit 72 may be embedded with a touch panel. In this manner, the display unit 72 also functions as the operation unit 74. An operation which is received by the display unit 72 is read using the control unit 60.

The operation unit 74 includes various buttons which a user operates. The operation unit 74 includes a menu button 742, a decoloring button 744, and a reading retrieving button 746. The operation unit 74 includes a setting-registering button 748, a ten key button 750, and a power button 752. The operation unit 74 includes a reset button 754, a stop button 756, and a start button 758. An operation which is received in the operation unit 74 is read using the control unit 60.

The control unit 60 includes a central processing unit (CPU) 62 and a storage unit 64. The storage unit 64 is a non-temporary recording medium for recording a program which is readable using the CPU 62. The CPU 62 reads a program which is stored in the storage unit 64. The CPU 62 performs processing according to the program.

The CPU 62 includes a recognition unit 620. The recognition unit 620 recognizes an image which is read using the reading unit 20. A particular shape may be included in image data of the recognized image. The recognition unit 620 may convert the read image into character data by recognizing characters from the image which is read using the reading unit 20. The character data may be a character code. The recognition unit 620 obtains image data or character data as a recognition result.

The CPU 62 switches an operation mode of the decoloring apparatus 1 between a usual operation mode and a reading retrieving mode. The CPU 62 receives an operation of the decoloring button 744, and switches the operation mode to the usual operation mode. The CPU 62 receives an operation of the reading retrieving button 746, and switches the operation mode to the reading retrieving mode.

The usual operation mode is an operation mode in which an image on the sheet P1 is decolored using the decoloring unit 30, after reading the image on the sheet P1 using the reading unit 20. The reading retrieving mode is an operation mode in which decoloring is not performed on a sheet on which an image which matches a retrieving condition is formed. The retrieving condition may be character data or image data which is set in advance. The character data or the image data, which is set in advance, may be characters or patterns which denote that decoloring of the sheet should not be performed. The characters or patterns are stored in the storage unit 64 in advance. The retrieving condition may be character data or image data which is input according to an operation of a user.

In the reading retrieving mode, the CPU 62 determines whether decoloring using the decoloring unit 30 is performed based on a result which is recognized by the recognition unit 620. In the reading retrieving mode, the CPU 62 proceeds with controlling the decoloring process when determining that the decoloring should be performed. The CPU 62 does not proceed with performing the decoloring process when determining that the decoloring should not be performed.

For example, the CPU 62 may not perform the decoloring when the image data which is recognized by the recognition unit 620 matches the image data which is set in advance. For example, the image data which is set in advance may denote an image of "minutes".

As another example, the CPU 62 may not perform the decoloring when character data which is recognized by the recognition unit 620 includes the character data which is set in advance. For example, the character data which is set in advance may denote a character string of "minutes".

As another example, the CPU 62 may cause the decoloring not to be performed when the character data which is recognized by the recognition unit 620 includes the character data which is input by the control panel 70. The control panel 70 may receive an operation of a user, and input character data (character input unit). The CPU 62 compares the character data which is recognized by the recognition unit 620 with the character data which is input from the control panel 70. When the character data which is recognized by the recognition unit 620 matches the character data which is input from the control panel 70, the CPU 62 determines that the decoloring is not performed.

The control unit 60 may receive image data or character data through a communication line. The communication line is a wireless LAN which transmits information which is transmitted from a personal computer, or the like, which is connected to the decoloring apparatus 1, the Ethernet®, or the like. The image data or the character data which is received through a communication line is stored in the storage unit 64. The stored image data is used as the above described image data which is set in advance in the reading retrieving mode. Likewise, the stored character data is used as the above described character data which is set in advance in the reading retrieving mode.

In addition, the control unit 60 may accumulate the character data or the image data which is transmitted from the personal computer, or the like, as a job. The accumulated job may be selected in the reading retrieving mode. When selecting the job, the control unit 60 may authenticate a user. User authentication may be card authentication in which a card which the user holds is authenticated. In the card authentication, information which is set in advance is compared with information stored in the card, and a recognized result is obtained.

In this manner, the control unit 60 determines whether or not to perform decoloring based on the image data or character data which is input through the communication line.

When performing decoloring, the decoloring apparatus 1 transports the sheet P1 to the decoloring unit 30, and decolors the sheet in the decoloring unit 30. The decoloring apparatus 1 causes the reading unit 20 to read the image on the sheet P1 again, after the decoloring. When the decoloring is completed, the decoloring apparatus 1 transports the sheet P1 to a cassette corresponding to the decoloring state.

When the decoloring is not performed, the decoloring apparatus 1 does not cause the sheet P1 to be transported to the decoloring unit 30. The decoloring apparatus 1 transport the sheet P1 which is not decolored to a cassette other than the disposal cassette 46. According to the embodiment, a cassette other than the disposal cassette 46 is the retrieving cassette 42 or the reuse cassette 44.

The decoloring apparatus 1 may temporarily stop the sheet P1 which passes through the reading unit 20. For this reason, in the decoloring apparatus 1, a driving roller for transporting (not illustrated) is provided between the image sensor and a branch point of the transport paths R2 and R4 in the reading unit 20. The decoloring apparatus 1 stops transporting of the sheet P1 by stopping the driving roller for transporting.

If decoloring is to be performed, the decoloring apparatus 1 transports the sheet P1 which is stopped by the driving roller to the decoloring unit 30. If decoloring is not to be performed, the decoloring apparatus 1 transports the sheet P1 which is stopped by the driving roller to the discharging unit 40. In this manner, it is possible to temporarily stop the sheet P1 for a period of time until whether or not to perform decoloring is determined, after the image on the sheet P1 is read using the reading unit 20.

Figure 5:
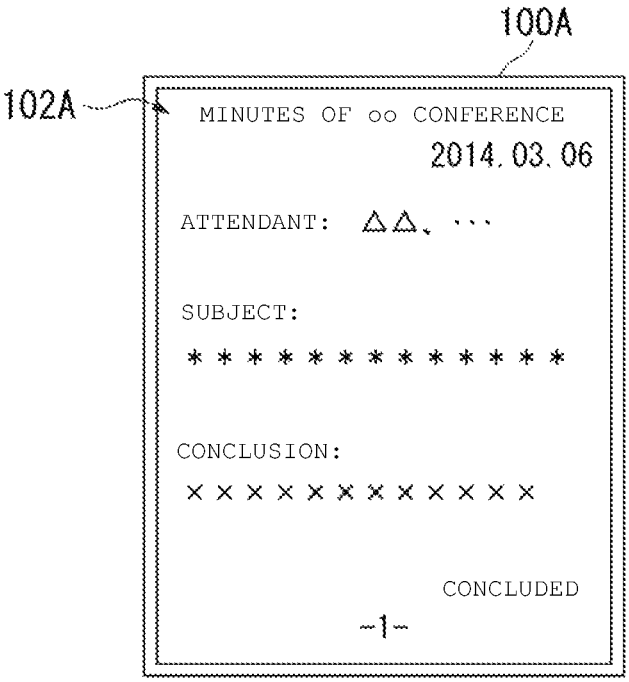
FIG. 5 is a plan view which illustrates a sheet which matches retrieving conditions.
Figure 6:
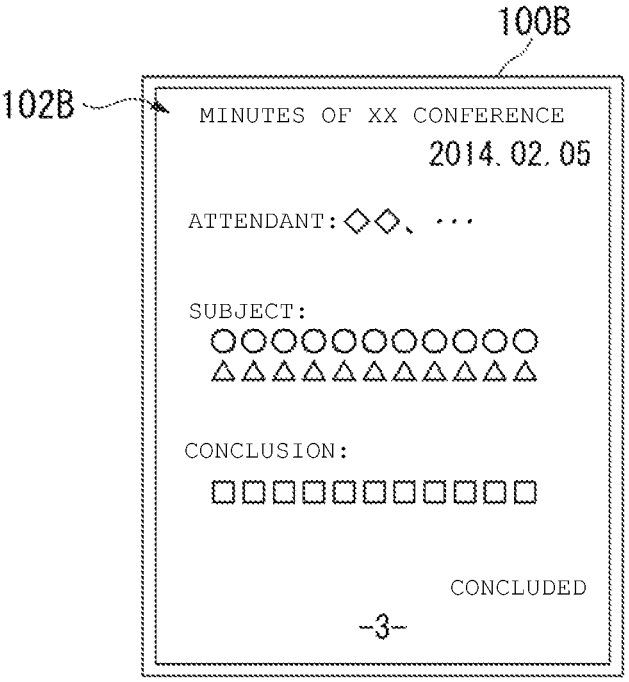
FIG. 6 is a plan view which illustrates a sheet which does not match retrieving conditions.
Figure 7:
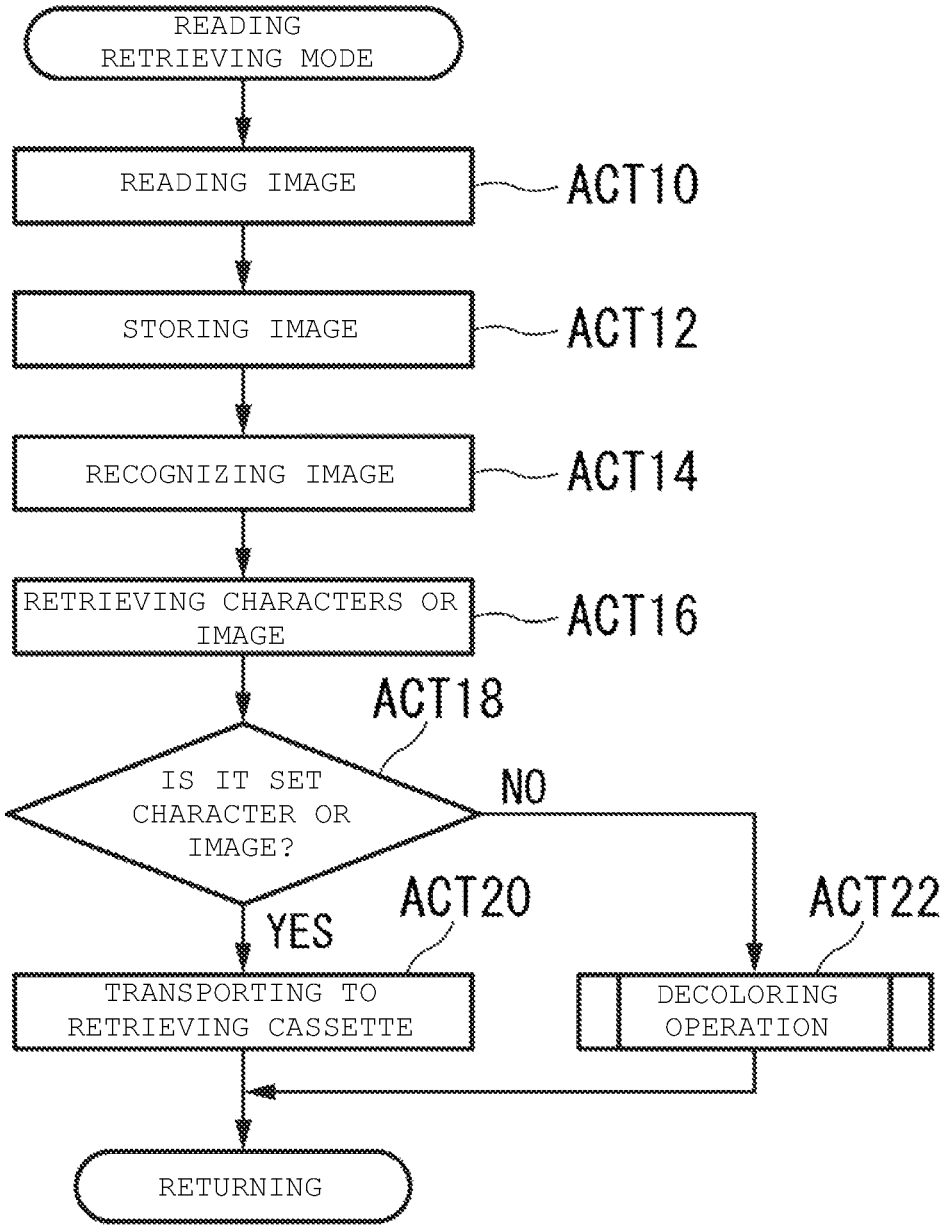
FIG. 7 is a flowchart which illustrates an example sequence of operations of a reading retrieving mode in the decoloring apparatus.
Figure 8:
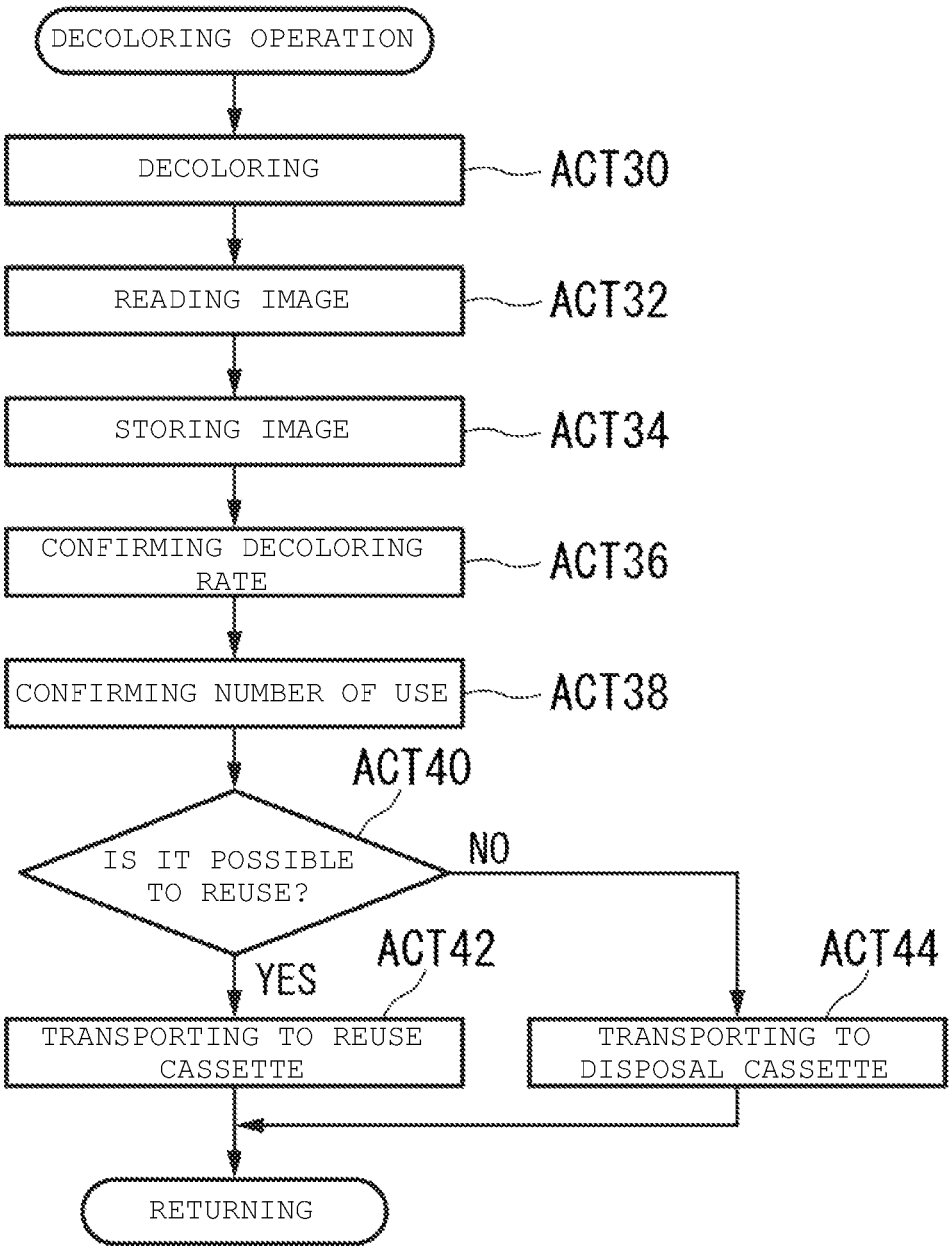
FIG. 8 is a flowchart which illustrates an example sequence of operations of a decoloring process in the decoloring apparatus.
Figure 9:
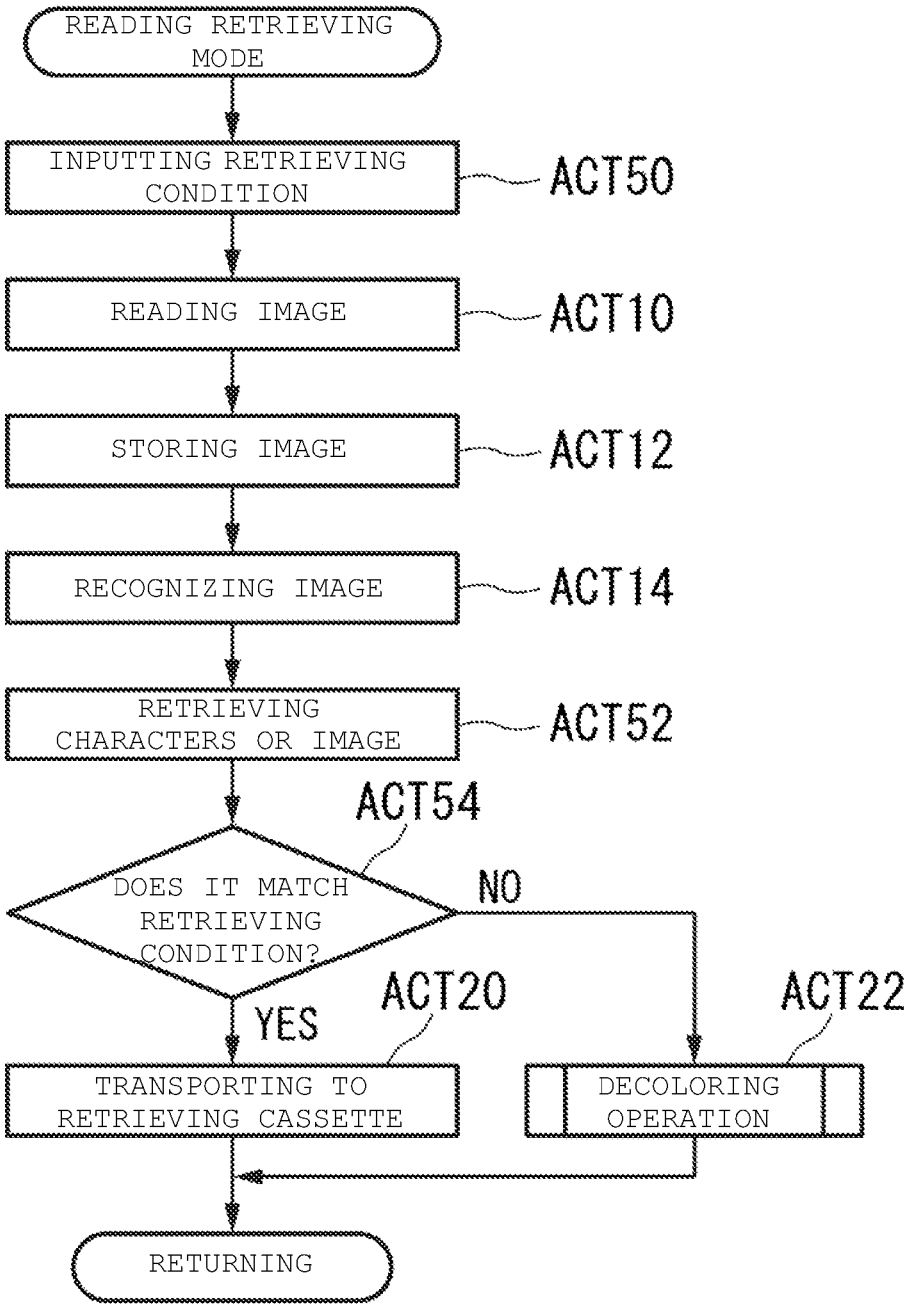
FIG. 9 is a flowchart which illustrates another example sequence of operations of the reading retrieving mode in the decoloring apparatus.

Subsequently, operation of the decoloring apparatus 1 which is configured as described above will be described. FIG. 5 illustrates an example of a sheet 100A which matches retrieving conditions in the operation of the decoloring apparatus 1 which will be described later. FIG. 6 illustrates an example of a sheet 100B which does not match the retrieving conditions in the operation of the decoloring apparatus 1 which will be described later. FIG. 7 is a flowchart which illustrates example sequence of operations of the reading retrieving mode using the decoloring apparatus 1. FIG. 8 is a flowchart which illustrates an example sequence of operations of decoloring operations using the decoloring apparatus 1. FIG. 9 is a flowchart which illustrates another example sequence of operations of the reading retrieving mode in the decoloring apparatus 1.

The reading retrieving mode illustrated in FIG. 7 is started when the reading retrieving button 746 is pressed.

First, the control unit 60 transports the sheet P1 to the reading unit 20. The reading unit 20 reads an image which is formed on the transported sheet P1 (ACT 10).

Subsequently, the control unit 60 receives the image information from the reading unit 20. The control unit 60 stores the received image information in the storage unit 64 (ACT 12).

Subsequently, the recognition unit 620 recognizes the image information which is stored in ACT 12 (ACT 14). In this manner, the recognition unit 620 may recognize whether image information which is read using the reading unit 20 includes character data or image data, which is used in the retrieving process.

Subsequently, the CPU 62 retrieves whether the character data or image data which is recognized in ACT 14 matches the character data or image data which is set in advance, and is stored in the storage unit 64 (ACT 16). When the character data or image data which is recognized matches the character data or image data which is set in advance (Yes in ACT 18), the CPU 62 transports the sheet P1 to the retrieving cassette 42 (ACT 20). That is, the decoloring apparatus 1 determines that decoloring is not performed. When the character data or image data which is recognized does not match the character data or image data which is set in advance (No in ACT 18), decoloring is performed (ACT 22). That is, the decoloring apparatus 1 determines that decoloring is performed.

For example, the character data which is set in advance may be "minutes of oo conference". When the sheet 100A which is illustrated in FIG. 5 is transported to the reading unit 20, the CPU 62 may recognize characters 102A which is "minutes of oo conference". In this manner, the decoloring apparatus 1 may determine that decoloring of the image which is formed on the sheet 100A is not performed. On the other hand, when the sheet 100B which is illustrated in FIG. 6 is transported to the reading unit 20, the CPU 62 may recognize characters 102B which is "minutes of XX conference," which is not recognized as "minutes of oo conference". Due to this, the decoloring apparatus 1 may determine that decoloring of the image which is formed on the sheet 100B is performed.

As illustrated in FIG. 8, in the decoloring operation in ACT 22, the sheet P1 is transported to the decoloring unit 30 (ACT 30). In this manner, the decoloring unit 30 decolors the sheet P1. Subsequently, the reading unit 20 reads the image which is formed on the transported sheet P1 (ACT 32). Subsequently, the control unit 60 receives image information from the reading unit 20. The control unit 60 stores the received image information in the storage unit 64 (ACT 34).

Subsequently, the control unit 60 confirms a decoloring rate of an image based on the stored image information (ACT 36). The decoloring rate is a ratio of an area of a portion in which a coloring agent is not developed to the total area of the sheet P1 after being decolored using the decoloring unit 30.

Subsequently, the control unit 60 confirms a number of uses of the sheet P1 based on the stored image information (ACT 38). The control unit 60 may determine the number of use of the sheet P1 based on a barcode image which is formed on the sheet P1.

Subsequently, the control unit 60 determines whether or not it is possible to reuse the sheet P1 (ACT 40). The control unit 60 determines whether or not the decoloring rate of an image is equal to or smaller than a predetermined value, and/or whether or not the number of uses is equal to or smaller than a predetermined number of times. When the decoloring rate of the image is equal to or smaller than the predetermined value, and/or the number of use is equal to or smaller than the predetermined number of times, the control unit 60 determines that the sheet P1 may be reused. When the decoloring rate of the image is equal to or smaller than the predetermined value, and/or the number of use is not equal to or smaller than the predetermined number of times, the control unit 60 determines that the sheet P1 cannot be reused.

When the sheet P1 may be reused (Yes in ACT 40), the control unit 60 transports the sheet P1 to the reuse cassette 44 (ACT 42). When the sheet P1 cannot be reused (No in ACT 40), the control unit 60 transports the sheet P1 to the disposal cassette 46 (ACT 44).

As described above, according to the decoloring apparatus 1, it is possible to determine that decoloring is not performed when an image or characters set in advance are formed on the sheet P1.

In the reading retrieving mode, a retrieving condition may be input as illustrated in ACT 50 in FIG. 9. The reading retrieving mode illustrated in FIG. 9 is started when the reading retrieving button 746 is operated. The control panel 70 inputs the retrieving condition based on a user operation (ACT 50). The control unit 60 stores the retrieving condition input using the control panel 70 in the storage unit 64.

In ACT 50, the control panel 70 may cause the screen which is illustrated in FIG. 4 to be displayed. The screen in FIG. 4 includes an operation mode 722, a message 724, and an input keyword 726. The operation mode 722 denotes a "reading retrieving mode" which is a current operation mode. The message 724 denotes, for example, a phrase of "Please input a keyword" which is a requested act for a user.

The control panel 70 displays the input keyword 726 as an input retrieving result. The input keyword 726 denotes "minutes of oo conference". The control unit 60 receives the "minutes of oo conference" which is a character string as the retrieving condition based on the operation input using the control panel 70. In this manner, the control unit 60 may receive character data as the retrieving condition.

The control panel 70 may receive image data as the retrieving condition. The control panel 70 stores the image data which is the retrieving condition, and displays the image data on the display unit 72. The control panel 70 may receive the selected image data as the retrieving condition based on a user operation. The control panel 70 may receive the image data as the retrieving condition according to a user operation by displaying the image data which is input through a communication line on the display unit 72.

Subsequently, the decoloring apparatus 1 performs the above described processes of ACT 10 to ACT 14. The CPU 62 recognizes the image formed on the sheet P1, and obtains character data or image data as a recognition result.

Subsequently, the CPU 62 retrieves whether or not the character data or image data which is recognized in ACT 14 matches the character data or image data as the retrieving condition (ACT 52). When the recognized character data or image data matches the character data or image data as the retrieving condition (Yes in ACT 54), the CPU 62 transports the sheet P1 to the retrieving cassette 42 (ACT 20). That is, the decoloring apparatus 1 determines that decoloring is not performed. When the recognized character data or image data does not match the character data or image data as the retrieving condition (No in ACT 54), the decoloring unit 30 performs decoloring (ACT 22). That is, the decoloring apparatus 1 determines that decoloring is performed.

According to at least one embodiment which is described above, whether or not decoloring using the decoloring unit 30 is performed is determined based on the image information read by the reading unit 20. According to the decoloring apparatus 1, when a specific sheet P1 among a plurality of sheets P1 is desired to be not subject to decoloring, it is possible to determine that decoloring of the specific sheet P1 is not performed. Also, according to the decoloring apparatus 1, it is possible to reuse the sheet P1 by decoloring an image in order to reduce an environmental load. In addition to this, according to the decoloring apparatus 1, it is possible to prevent the specific sheet P1 from being subjected to decoloring and subsequent reprinting, in order to retrieve the specific sheet P1. In this manner, according to the decoloring apparatus 1, it is possible to suppress consumption of toner for decoloring and reprinting. In addition, the decoloring apparatus 1 may suppress consumption of thermal energy for fixing and erasing.

According to the decoloring apparatus 1, when the image information read by the reading unit 20 includes an image which is set in advance, it is determined that decoloring using the decoloring unit 30 is not performed. In this manner, according to the decoloring apparatus 1, when a specific image is formed on the sheet P1, it is possible to suppress consumption of thermal energy for decoloring.

According to the decoloring apparatus 1, when the characters recognized by the reading unit 20 include a character string which is set in advance, it is determined that decoloring using the decoloring unit 30 is not performed. In this manner, according to the decoloring apparatus 1, when specific characters are formed on the sheet P1, it is possible to suppress consumption of thermal energy for decoloring.

According to the decoloring apparatus 1, when the characters recognized by the reading unit 20 include a character string which is input, it is determined that decoloring using the decoloring unit 30 is not performed. In this manner, according to the decoloring apparatus 1, when the input characters are formed on the sheet P1, it is possible to suppress consumption of thermal energy for decoloring.

According to the decoloring apparatus 1, the usual operation mode and the reading retrieving mode may be switched using an operation. In this manner, according to the decoloring apparatus 1, it is possible to determine that decoloring of a specific sheet P1 is not performed using an operation.

According to the decoloring apparatus 1, the sheet P1 of which decoloring using the decoloring unit 30 is determined not to be performed is transported to a cassette other than the disposal cassette 46. In this manner, according to the decoloring apparatus 1, it is possible to prevent the specific sheet P1 which is not subjected to decoloring from being discarded.

According to the decoloring apparatus 1, there is an exclusive retrieving cassette 42 to which a sheet which is determined not to be subjected to decoloring using the decoloring unit 30 is discharged. In this manner, according to the decoloring apparatus 1, it is possible to transport the specific sheet P1 to the retrieving cassette 42.

While certain embodiments have been described, these embodiments have been presented by way of example only, and are not intended to limit the scope of the inventions.

Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A decoloring apparatus comprising:

a reading unit configured to read an image formed on a sheet and output image information corresponding to the read image;

a decoloring unit configured to decolor the image formed on the sheet;

a character input unit that receives input of a character string; and a control unit including a processor configured to recognize the image information output by the reading unit, including characters included in the image information; and determine whether decoloring using the decoloring unit is performed on the sheet based on the recognized image information, so that decoloring on the sheet is not performed when the recognized characters correspond to the character string input in the character input unit.

2. The apparatus according to claim 1, further comprising:

an operation unit that switches an operation mode of the apparatus between a decoloring mode in which an image on a sheet is read using the reading unit and is decolored using the decoloring unit and a reading retrieving mode in which the control unit determines whether to perform decoloring using the decoloring unit.

3. The apparatus according to claim 1, further comprising:

a transport unit configured to convey the sheet to any one of a plurality of discharge units including a disposal unit, wherein the transport unit transports the sheet to a discharge unit other than the disposal unit if the control unit determines not to perform decoloring on the sheet using the decoloring unit.

4. The apparatus according to claim 3, wherein the plurality of discharge units includes a retrieving unit, wherein the transport unit transports the sheet to the retrieving unit if the control unit determines not to perform decoloring on the sheet using the decoloring unit.

5. The apparatus according to claim 1, further comprising:

a storage unit that stores the image information read by the reading unit.

6. A decoloring method comprising the steps of:

reading an image formed on a sheet;

outputting image information corresponding to the read image;

receiving input of a character string;

recognizing the image information, including recognizing characters included in the image information; and determining whether to perform decoloring of the image formed on the sheet based on the recognized image information, wherein decoloring of the image formed on the sheet is determined not to be performed when the recognized characters correspond to the input character string.

7. The method according to claim 6, the steps further comprising:

conveying the sheet to any one of a plurality of discharge units including a disposal unit, wherein the sheet is conveyed to a discharge unit other than the disposal unit if decoloring of the image formed on the sheet is determined not to be performed.

8. The method according to claim 7, wherein the plurality of discharge units includes a retrieving unit, wherein the sheet is conveyed to the retrieving unit if decoloring of the image formed on the sheet is determined not to be performed.

9. A non-transitory computer-readable recording medium storing instructions causing a processor to control a decoloring apparatus to perform the steps of:

reading an image formed on a sheet;

outputting image information corresponding to the read image;

receiving input of a character string;

recognizing the image information, including recognizing characters included in the image information; and determining whether perform decoloring of the image formed on the sheet based on the recognized image information, wherein decoloring of the image formed on the sheet is determined not to be performed when the recognized characters correspond to the input character string.

10. The computer-readable recording medium according to claim 9, wherein the instructions cause the processor to control the decoloring apparatus to further perform the steps of:

conveying the sheet to any one of a plurality of discharge units including a disposal unit, wherein the sheet is conveyed to a discharge unit other than the disposal unit if decoloring of the image formed on the sheet is determined not to be performed.

11. The computer-readable recording medium according to claim 9, wherein:

the plurality of discharge units includes a retrieving unit, and the instructions cause the processor to control the decoloring apparatus so that the sheet is conveyed to the retrieving unit if decoloring of the image formed on the sheet is determined not to be performed.

* * * * *